US007543576B2

(12) United States Patent
Okada et al.

(10) Patent No.: US 7,543,576 B2
(45) Date of Patent: Jun. 9, 2009

(54) EXHAUST-GAS RECIRCULATION SYSTEM

(75) Inventors: Hidetoshi Okada, Tokyo (JP); Toshihiko Miyake, Tokyo (JP); Hisashi Yokoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 21 days.

(21) Appl. No.: 11/666,693

(22) PCT Filed: Oct. 26, 2005

(86) PCT No.: PCT/JP2005/019722

§ 371 (c)(1),
(2), (4) Date: May 1, 2007

(87) PCT Pub. No.: WO2006/075430

PCT Pub. Date: Jul. 20, 2006

(65) Prior Publication Data

US 2008/0135026 A1 Jun. 12, 2008

(30) Foreign Application Priority Data

Jan. 14, 2005 (JP) ..... 2005-008030

(51) Int. Cl.
*F02B 47/08* (2006.01)
*F02M 25/07* (2006.01)

(52) U.S. Cl. ..... 123/568.17

(58) Field of Classification Search ..... 123/568.17, 123/568.18, 568.29, 568.11
See application file for complete search history.

(56) References Cited

U.S. PATENT DOCUMENTS 4,276,865 A * 7/1981 Hamai ..... 123/275
4,615,324 A * 10/1986 Choushi et al. ..... 123/568.17
6,209,529 B1 * 4/2001 Everingham ..... 123/568.2
6,378,509 B1 * 4/2002 Feucht et al. ..... 123/568.12
7,013,880 B2 * 3/2006 Watanuki et al. ..... 123/568.2

FOREIGN PATENT DOCUMENTS

JP 57-56655 A 4/1982
JP 62-294757 A 12/1987
JP 10-246114 A 9/1998

OTHER PUBLICATIONS

Microfilm of the specification and drawings annexed to the request of Japanese Utility Model Application No. 93835/1976 (Laid-open No. 12919/1978) (Nissan Motor Co., Ltd.), Feb. 2, 1978, Full text; all drawings.

* cited by examiner

*Primary Examiner*—Mahmoud Gimie
(74) *Attorney, Agent, or Firm*—Birch, Stewart, Kolasch & Birch, LLP

(57) ABSTRACT

An exhaust-gas introducing passage is branched, on an outlet side of a valve, into parts, correspondingly to the number of an exhaust port of an internal combustion engine and the branching section is located at a position directly opposed to a movable valving element of the valve so as to cause exhaust gas to easily flow only in the direction of the outlet, which has introducing passages of exhaust gas communicating with a plurality of intake ports of the internal combustion engine to approach as near as possible a state in which each of the introducing passages is isolated from another introducing passages, and they assume an aspect just as if the introducing passages do not substantially communicate with one another.

6 Claims, 15 Drawing Sheets

EXHAUST-GAS RECIRCULATION SYSTEM

TECHNICAL FIELD

The present invention relates to an exhaust-gas recirculation system used for an internal combustion engine.

BACKGROUND ART

The regulation of exhaust gas of internal combustion engines such as engines of motor vehicles is gradually tightening in all the world, and under the circumstances, exhaust-gas recirculation systems (so-called EGR: Exhaust Gas Recirculation) are being used, which recirculates exhaust gas to intake for reducing $NO_x$ contained in the exhaust gas. For example, there has been suggested, e.g., an exhaust-gas recirculation system including a takeoff passage of exhaust gas communicating with an exhaust port in an internal combustion engine; an introducing passage communicating with an intake port of the engine; an opening and closing valve provided between the takeoff passage and the introducing passage; and a control means for controlling an opening and closing operation of the opening and closing valve; wherein the exhaust-gas recirculation system is arranged such that the introducing passage is branched, on an outlet side of the opening and closing valve, correspondingly to the number of the exhaust port of the internal combustion engine (see Patent Document 1, for example).

Technological contents disclosed in this Patent Document 1 is that exhaust gas from an EGR passage admitted to a source of exhaust is introduced, through an EGR valve, into a plurality of air-gas intake passages provided, correspondingly to the number of cylinders of the internal combustion engine.

In the engine having such an arrangement, it has an fear of an aggravation originated from fall-off of negative pressure (getting near to the atmospheric pressure) at the intake port, caused by taking an intake in another cylinders, which invites lowering of the amount of air to be taken in by inertia.

Patent Document 1: JP-A62-294757

The conventional exhaust-gas recirculation system is thus arranged as mentioned above, and therefore, the EGR-gas introducing passages thereof are in communication with one another between mouths of a plurality of inlet valves located at positions spaced away from the valve. Therefore, the communication with another inlets through another EGR gas introducing passages incurs an aggravation of an intake efficiency, when observing an arbitrary EGR-gas introducing passage.

The present invention has been made to solve the above-mentioned problem, and an object of the present invention is to provide an exhaust-gas recirculation system able to ravel out the aggravation of the intake efficiency with a simple mechanism.

DISCLOSURE OF THE INVENTION

The exhaust-gas recirculation system according to the present invention is arranged such that the introducing passage of exhaust gas is branched, on an outlet side of a valve, correspondingly to the number of an exhaust port of an internal combustion engine, and a branching section is located at a position directly opposed to a movable valving element of the valve to cause exhaust gas easily flow only in the direction of an outlet thereof. This enables respective introducing ports of the internal combustion engine communicating with a plurality of introducing passages of exhaust gas to approach as near as possible a state in which each of the introducing passages is isolated from the other introducing passages, and assumes an aspect just as if the introducing passages do not substantially communicate with one another.

According to the present invention, the invention can ravel out the degradation of the intake efficiency of each of the cylinders of the internal combustion engine while maintaining a simple arrangement where the valve is shared.

BEST MODE FOR CARRYING OUT THE INVENTION

Embodiments of the present invention will now be described hereinafter with reference to the accompanying drawings.

FIRST EMBODIMENT

Figure 1:
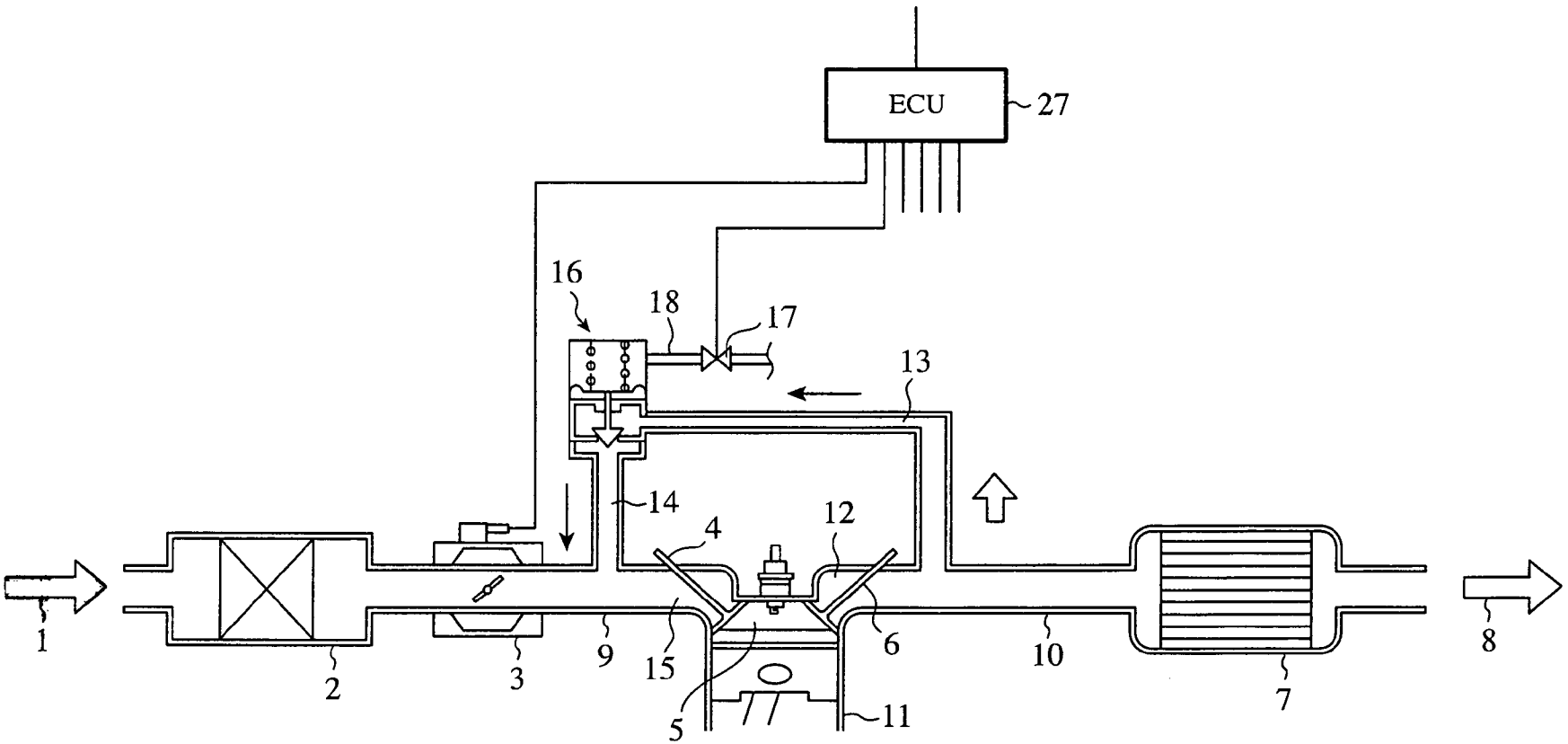
FIG. 1 is a view explaining an outline of the exhaust-gas recirculation system.

FIG. 1 is a view explaining an outline of an exhaust-gas recirculation system according to the first embodiment. Air taken into an air cleaner 2 in the direction shown by an arrow 1 is, through a tubular intake passage 9 and a throttle valve 3 provided thereabove, introduced into an internal combustion engine, identified here for convenience of explanation, through an inlet valve 4 of a cylinder 11 constituting the internal combustion engine. The burned exhaust gas is exhausted from a combustion chamber 5 to a tubular exhaust passage 10 through an exhaust valve 6, and then is exhausted into the atmosphere in a manner as indicated by an arrow 8 through a catalyst section 7 provided above the exhaust passage 10 for removing harmful components.

Here, the exhaust-gas recirculation system is provided in order to reduce the harmful components contained in the exhaust gas by mixing new fuel-air mixture into the exhaust gas and by recirculating the gas mixture to an intake for combustion. A tubular takeoff passage 13 of exhaust gas branched from the exhaust passage 10 is provided therein. This takeoff passage 13 communicates with an exhaust port 12 constituting an outlet of the exhaust valve 6. Further, a tubular introducing passage 14 of exhaust gas branched from the intake passage is also provided therein. This introducing passage 14 communicates with an intake port 15 constituting an inlet of the inlet valve 4.

An EGR (Exhaust Gas Recirculation) valve 16 is provided between the takeoff passage 13 and the introducing passage 14. The EGR valve 16 opens and closes by contacting its movable valving element with a valve seat and separating it therefrom. The EGR valve 16 is arranged in the first embodiment that the valve be in a closed state by urging the movable valving element with a spring, and at the time of valve opening, negative pressure be applied to the movable valving element against repulsion of the spring to pull out the element.

The negative pressure is applied to the valve through a tube 18 connected to the EGR valve 16, and an application or non-application of the negative pressure acting as an external force moving the movable valving element is controlled by opening and closing a solenoid valve 17 mounted at the midway of the tube 18. The solenoid valve 17 is opened and closed in response to a control signal from an ECU (Engine Control Unit) 27 that is a control means. An ECU 27 also has charge of controlling an opening and closing operation of the throttle valve 3.

FIG. 1 shows solely a single cylinder for its nature of the schematic diagram; however, actually, a motor vehicle is driven, e.g., by the internal combustion engine having a plurality of cylinders. On the contrary, the EGR valve 16 is arranged so as to be shared by the plurality of cylinders, to exploit only one EGR valve therein.

Figure 2:
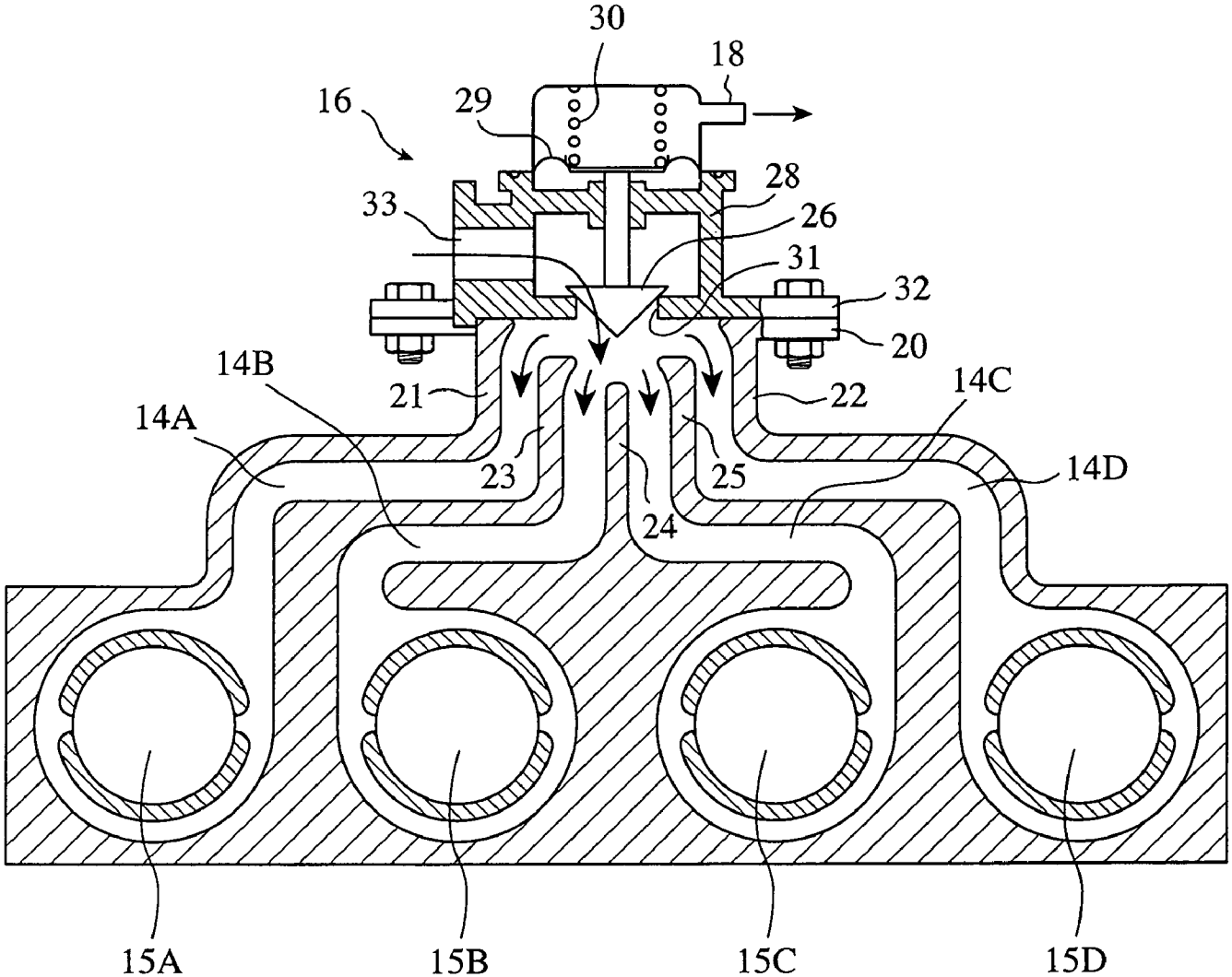
FIG. 2 is a sectional view of the EGR valve and an intake path thereof.

FIG. 2 is an example of the exhaust-gas recirculation system applied to a four-cylinder engine, including four intake ports 15A, 15B, 15C, and 15D each consisting of a sleeve corresponding to the four cylinders. Further, one end of the introducing passages 14A, 14 B, 14C, and 14D are admitted to these four intake ports 15A, 15B, 15C, and 15D individually corresponding thereto to provide communication between these introducing passages and the respective intake ports. Meanwhile, the other end of the introducing passages 14A, 14B, 14C, and 14D merge into one at a flange 20.

Particularly, a sidewall 21 forming part of the introducing passage 14A and a sidewall 22 forming part of the introducing passage 14D are integrated with the flange 20, and respective ends of a boundary wall 23 between the introducing passage 14A and the introducing passage 14B; a boundary wall 24 between the introducing passage 14B and the introducing passage 14C; and a boundary wall 25 between the introducing passage 14C and the introducing passage 14D are, at a position close to the movable valving element 26, in a directly-opposed positional relationship to the movable valving element 26.

A shaft of the movable valving element 26 is slidably supported by a frame 28 of the EGR valve 16, and the end of the shaft is secured to a diaphragm 29. The diaphragm 29 is pressed by an expandable spring 30, and when the valving element 26 is pressure contacted with a valve seat 31 by pressure, the EGR valve is in a closing state.

When drawing in air through the tube 18 by opening the solenoid valve 17 depicted in FIG. 1 and applying negative pressure to the diaphragm 29, the spring 30 bends and the valving element 26 separates from the valve seat 31. This state is a valve opening state. Additionally, at a lower portion of the frame 28 is provided a flange 32, and the flange is integrated with a bolt thereon with frame 28 jointed with the flange 20.

The frame 28 is provided on its end with an inlet 33, communicating with the takeoff passage 13 shown in FIG. 1. This inlet 33 extends through an internal space of the frame 28 and a circular opening, which is opened and closed by the valving element 26, and finally communicates with each of the introducing passages 14A, 14B, 14C, and 14D.

Here, as mentioned above, the end of the boundary walls of each of the introducing passages 14A, 14B, 14C, and 14D, i.e., the branching section is in a directly-opposed positional relationship to the valving element 26 in the vicinity thereof. Therefore, each of the introducing passages 14A, 14B, 14C, and 14D is substantially of low communication with one another at the time of valve closing, whereas exhaust gas to be introduced in a manner as indicated by an arrow through the inlet 33 is as good as isolated among the introducing passages at the time of valve opening. Accordingly, the amount of air drawn in from the other cylinders through the communication section becomes smaller than that of the prior art at the time of valve closing. Therefore, the exhaust gas is not open to an interference of an intake, and with this simple arrangement in which one shared EGR valve 16 is used can ravel out the aggravation of the intake efficiency of each of the cylinders.

SECOND EMBODIMENT

Figure 3:
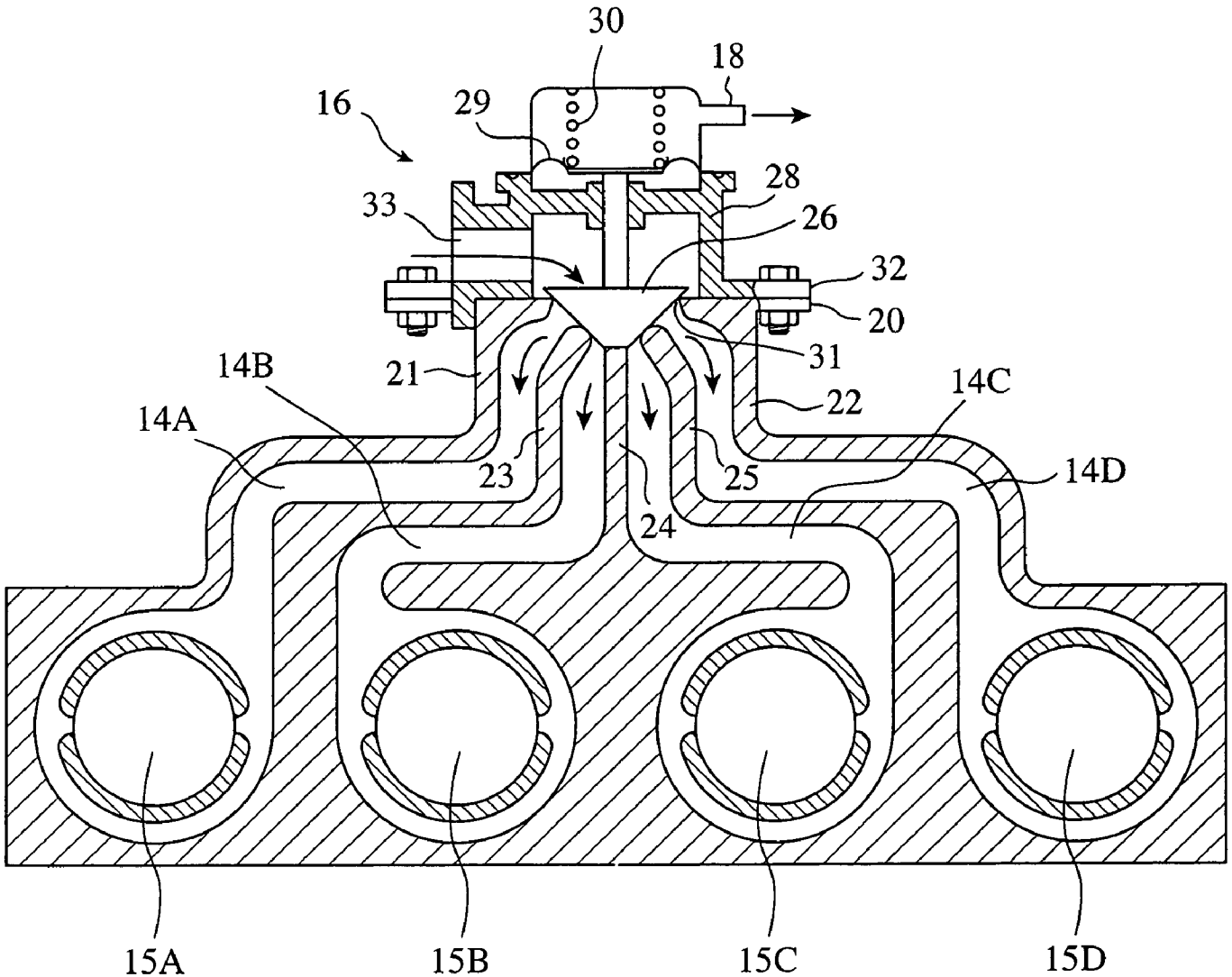
FIG. 3 is a sectional view of the EGR valve and an intake path thereof.

The second embodiment will be described with reference to FIG. 3. The second embodiment has sections in common with those of the arrangement shown in FIG. 2. Therefore, the same sections are designated by the same reference numerals, and explanations thereof are omitted for brevity's sake. The feature of the second embodiment is in that the branching section has a seating surface of the valve as shown in FIG. 2 at the end of the boundary walls of the introducing passages 14A, 14B, 14C, and 14D, i.e., at the branching section. As shown in FIG. 3, it is arranged such that the end of the boundary walls of the introducing passages 14A, 14B, 14C, and 14D be tightly contacted with the seating surface of the movable valving element 26 being in a closing state to form part of the seating surface of the valve.

In the second embodiment, viewing the flange 20 from above, the center thereof forms a concave like a mortar, and on a sloping face of the mortar, comes in sight the end of the introducing passages 14A, 14B, 14C and 14D in the shape of holes. Since the movable valving element 26 upwardly moves at the time of valve opening, which occurs a slight separation between the end of each of the boundary walls of the introducing passages 14A, 14B, 14C, and 14D and a conical face of the movable valving element 26, and forms a clearance therebetween, thereby being introduced exhaust gas through the clearance.

As shown in FIG. 3, the branching section is tightly contacted with the movable valving element 26 at the time of valve closing, thus turning the introducing passages 14A, 14B, 14C, and 14D into a closed state and ceasing drawing in an intake from another cylinders. For this reason, with this simple arrangement in which one shared EGR valve 16 is used can ravel out the aggravation of the intake efficiency of each of the cylinders.

THIRD EMBODIMENT

Figure 4:
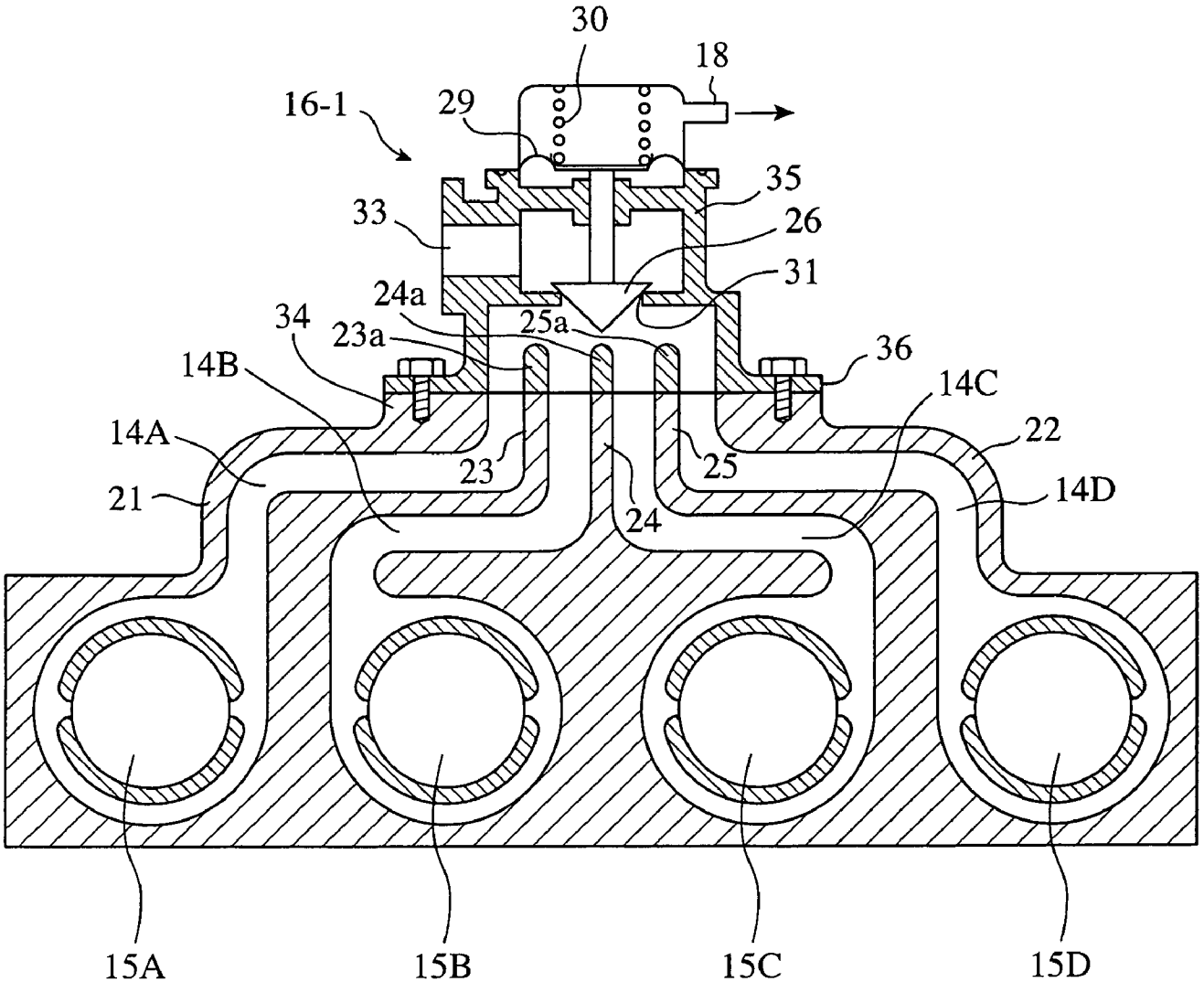
FIG. 4 is a sectional view of the EGR valve and an intake path thereof.

The third embodiment will be described with reference to FIG. 4. The third embodiment has sections in common with those of the arrangement shown in FIGS. 2 and 3. Therefore, the same sections are designated by the same reference numerals, and explanations thereof are omitted for brevity's sake. The feature of the third embodiment is in that the branching section thereof that is the end of the introducing passages 14A, 14B, 14C, and 14D, is provided within the valve.

A sidewall 21 forming part of the introducing passage 14A and a sidewall 22 forming part of the introducing passage 14D are integrated with a flange 34 for mounting an EGR valve 16-1 in which the branching section is housed, and the end of each of the boundary wall 23 between the introducing passage 14A and the introducing passage 14B; the boundary wall 24 between the introducing passage 14B and the introducing passage 14C; and the boundary wall 25 between the introducing passage 14C and the introducing passage 14D extends to an abutting face of the flange 34 (an attaching face of the EGR valve 16-1).

Meanwhile, a frame 35 of the EGR valve 16-1 is extended downward beyond a place at which the valve seat 31 is provided, and at a lower side of the frame 35 is formed with a flange 36 to be jointed to the flange 34. Further, in an internal space of the frame 35 is formed with boundary walls 23*a*, 24*a*, and 25*a* to be jointed to the boundary walls 23, 24, and 25, respectively, when the flanges 34 and 36 are jointed and secured with bolts.

These boundary walls 23*a*, 24*a*, and 25*a* are in a directly-opposed positional relationship to the valving element 26 in the vicinity thereof. At the time of valve 16-1 closing, as with the first embodiment, each of the introducing passages 14A, 14B, 14C, and 14D is substantially of low communication with one another, whereas at the time of valve opening exhaust gas to be introduced in a manner as indicated by arrows through the inlet 33 is as good as isolated among the introducing passages. Accordingly, the amount of air drawn in from another cylinders through the communication section becomes smaller than that of the prior art at the time of valve closing. Therefore, the exhaust gas is not open to an interference of an intake, and with this simple arrangement in which one shared EGR valve 16-1 is used can ravel out the aggravation of the intake efficiency of each of the cylinders.

In the third embodiment, as compared with the first and second embodiments in which the positional relationship between the branching section and the movable valve 26 is determined in an assembled situation, the branching section provided within the EGR valve 16-1 allows a more accurate control over and reduction in the aggravation of the intake efficiency of the cylinders by more precisely setting the positional relationship between them.

FOURTH EMBODIMENT

Figure 5:
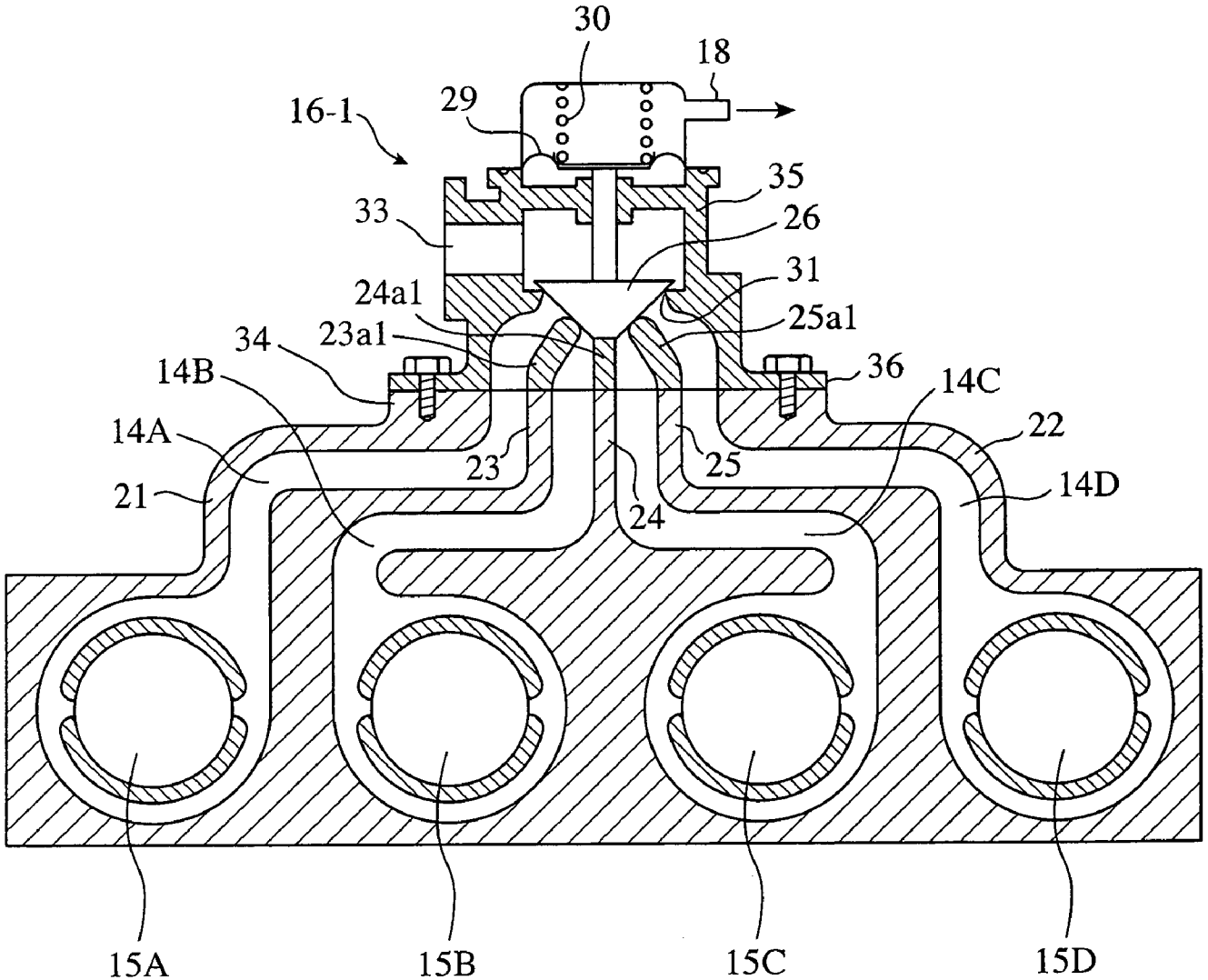
FIG. 5 is a sectional view of the EGR valve and an intake path thereof.

The fourth embodiment will be described with reference to FIG. 5. The fourth embodiment has sections in common with those of the arrangement shown in FIG. 4. Therefore, the same sections are designated by the same reference numerals, and explanations thereof are omitted for brevity's sake. Weighing FIG. 5 against FIG. 4, it turns out, as shown in FIG. 5, that the fourth embodiment is arranged such that the boundary walls 23*a*, 24*a*, and 25*a* in FIG. 4 are extended so as to be contacted with a conical face of the movable valving element 26. Specifically, the branching section corresponding to the end located on an extension line of the introducing passages 14A, 14B, 14C, and 14D, i.e., the end of the boundary walls 23*a*1, 24*a*1, and 25*a*1 is provided within an EGR valve 16-1 as the branching section, and further, the branching section acts as stationary partition sections partitioning the introducing passage, and still further as a seating surface contacted with the conical face of the movable valving element 26.

In the fourth embodiment, as compared with the first and second embodiments in which the positional relationship between the branching section and the movable valve 26 is determined in an assembled situation, the branching section is provided within the EGR valve 16-1 allows a more accurate control over and reduction in the aggravation of the intake efficiency by more precisely setting the positional relationship between them. Further, at the time of valve closing, the branching section is tightly contacted with the movable valving element 26 as shown in FIG. 5, thus turning the introducing passages 14A, 14B, 14C, and 14D into a closed state and ceasing drawing in an intake from another cylinders. For this reason, with this simple arrangement in which one shared EGR valve 16-1 is used can ravel out the aggravation of the intake efficiency of each of the cylinders.

FIFTH EMBODIMENT

Figure 6:
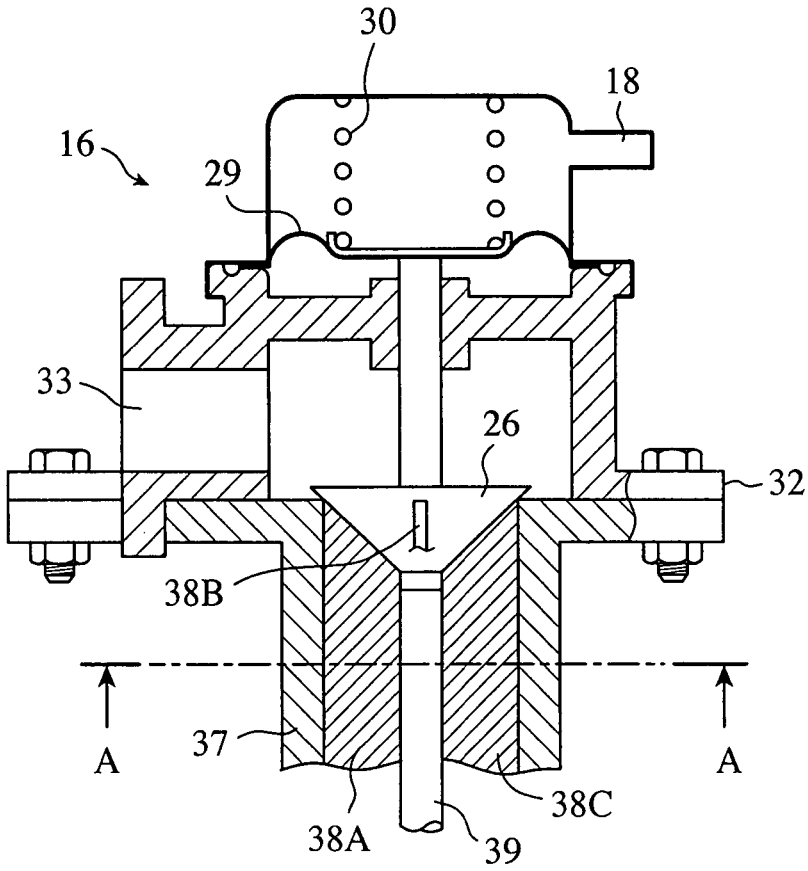
FIG. 6 is a sectional view of the EGR valve.
Figure 7:
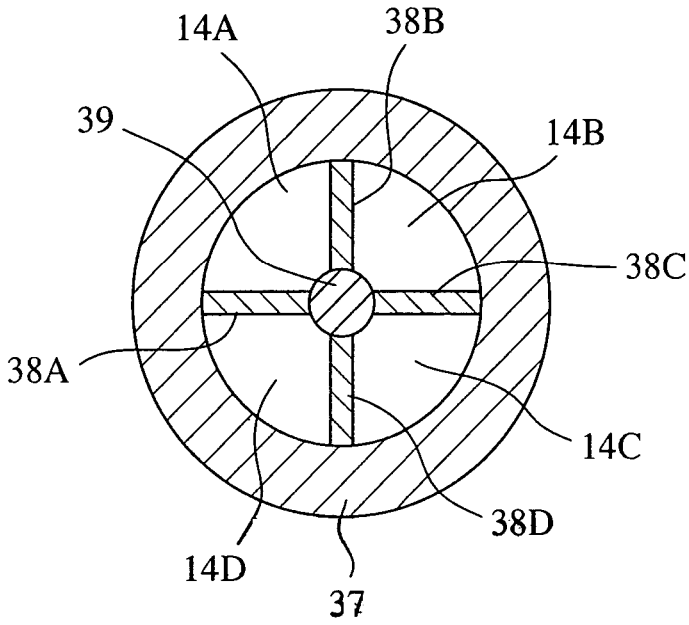
FIG. 7 is a sectional view of the EGR valve taken along line A-A in FIG. 6.

The fifth embodiment will be described with reference to FIG. 6 and FIG. 7. FIG. 6 is a sectional view of an EGR valve 16 and the introducing passage connected therewith. FIG. 7 is a sectional view thereof taken along line A-A in FIG. 6. In FIG. 6, the arrangement of the EGR valve 16 is the same as that in FIG. 2 and FIG. 3. A barrel 37 for the introducing passage, connected to the EGR valve 16, is a cylinder as shown in FIG. 7, and the interior of the barrel is partitioned into four circumferentially equally divided parts by four stationary partition plates 38A, 38B, 38C, and 38D. One end of each of these four stationary partition plates 38A, 38B, 38C, and 39D is secured to a shaft 39 positioned at the center of the cylinder, and the other end thereof is secured to an inner wall of the barrel 37.

These four areas partitioned by the stationary partition plates 38A, 38B, 38C, and 39D correspond to the introducing passages 14A-14D in the above embodiment, and therefore are designated by the same reference numerals. The stationary partition plates 38A, 38B, 38C, and 38D, partitioning the interior of the barrel 37 into four introducing passages 14A-14D, form the branching section, and the upper end of the stationary partition plates 38A, 38B, 38C, and 38D are arranged so as to be tightly contacted with the conical face of the movable valving element 26 at the time of EGR valve 16 closing.

In the fifth embodiment, at the time of EGR valve 16 closing, the communication between the introducing passages 14A-14D is completely cut off, which excludes an inflow of intake air from another introducing passages, and makes it possible to take in air efficiently.

SIXTH EMBODIMENT

Figure 8:
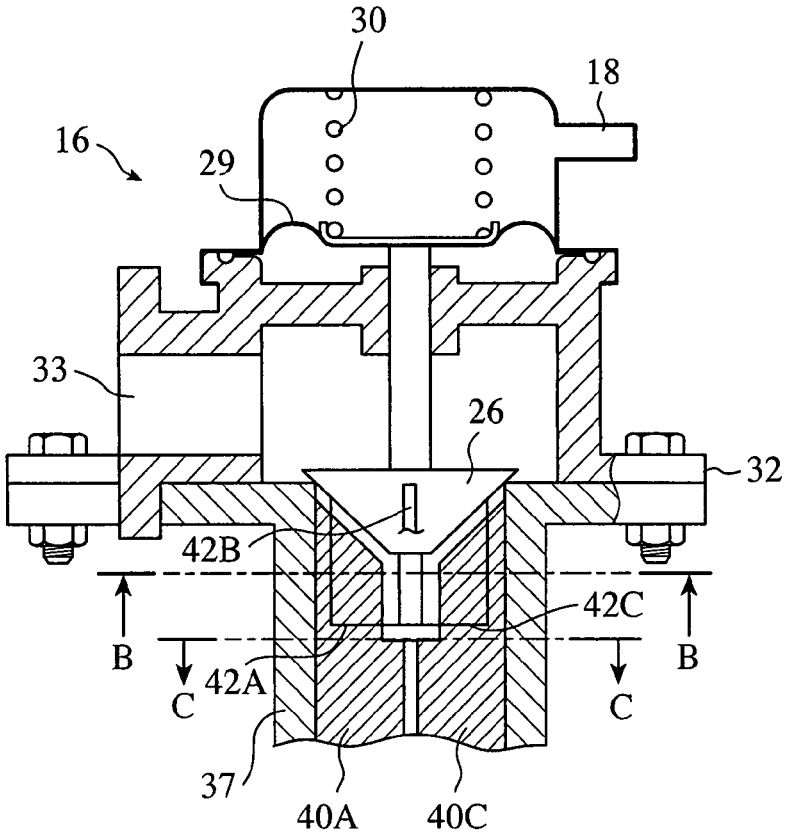
FIG. 8 is a sectional view of the EGR valve.
Figure 9:
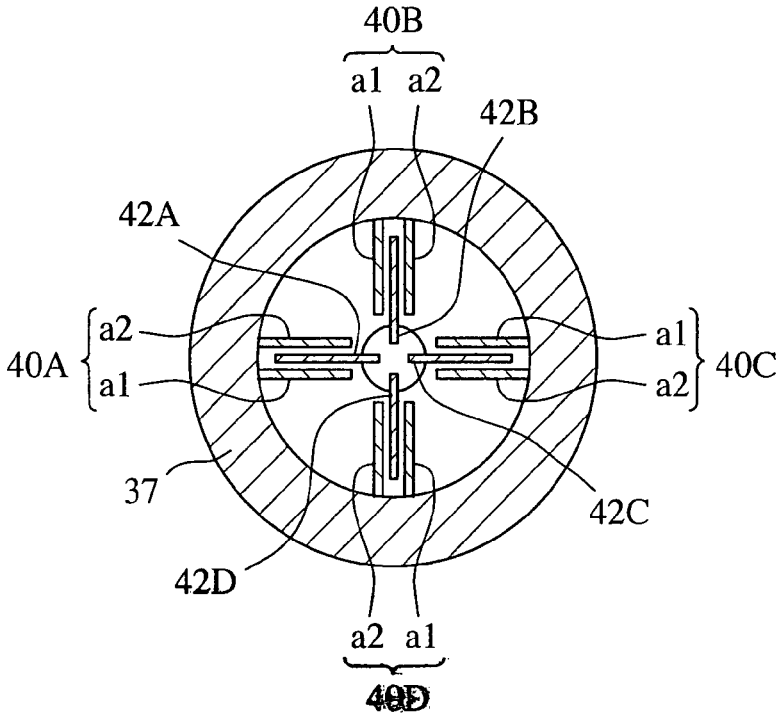
FIG. 9 is a sectional view of the EGR valve taken along line B-B in FIG. 8.
Figure 10:
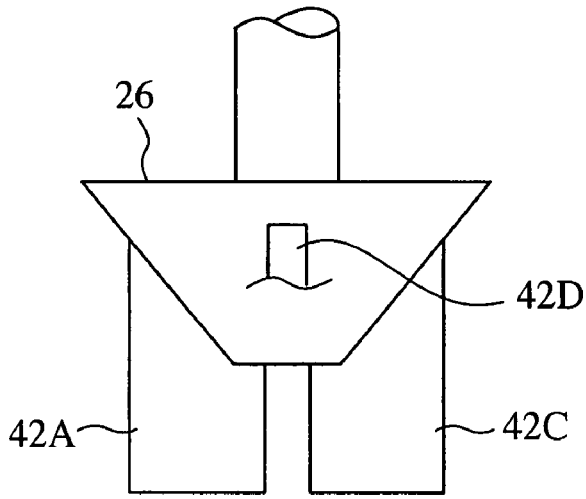
FIG. 10 is a front view of the movable valving element in FIG. 8.
Figure 11:
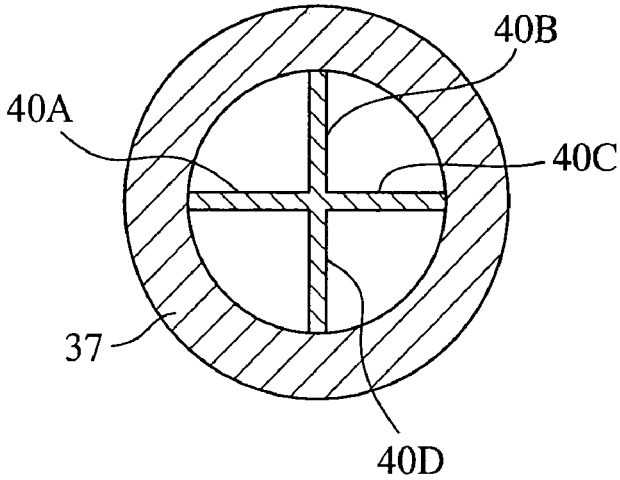
FIG. 11 is a sectional view of the EGR valve taken along line C-C in FIG. 8.

The sixth embodiment will be described with reference to FIGS. 8-11. FIG. 8 is a sectional view of an EGR valve 16 and the introducing passage connected therewith; FIG. 9 is a sectional view thereof taken along line B-B in FIG. 8; FIG. 10 is a view of the movable valving element, which is singled out therefrom for enlarged illustration and is viewed from the front; and FIG. 11 is a sectional view thereof taken along line C-C in FIG. 8. In FIG. 8, the arrangement of the EGR valve 16 is the same as that in FIG. 2 and FIG. 3. Therefore, the same sections are designated by the same reference numerals, and explanations thereof are omitted for brevity's sake.

A barrel 37 for the introducing passage, connected to the EGR valve 16, is a cylinder as shown in FIG. 9 and FIG. 11, and the interior of the cylinder is partitioned into four circumferentially equally divided parts by four stationary partition plates 40A, 40B, 40C, and 40D, each composed of a pair of two opposed plates a1, a2. These four partitioned areas communicate with the foresaid four introducing passages 14A, 14B, 14C, and 14D, respectively. Moreover, one end of each of these four stationary partition plates 40A, 40B, 40C, and 40D is fixed to the inner wall of the barrel 37.

Each of these stationary partition plates 40A, 40B, 40C, and 40D is composed of two opposed plates such that valve-integrated partition plates 42A, 42B, 42C, and 42D described later can be inserted therebetween. Under the line C-C in FIG. 8, there exists no valve-integrated partition plates 42A, 42B, 42C, and 42D. On account of this, as shown in FIG. 11, the interior of the cylinder, is partitioned into four circumferentially equal parts by not opposed plates, but by single plate at the same positions as those of the stationary partition plates 40A, 40B, 40C, and 40D.

Meanwhile, the valve-integrated partition plates 42A, 42B, 42C, and 42D are secured, at four circumferentially equally divided positions, to the periphery of the movable valving element 26. These valve-integrated partition plates 42A, 42B, 42C, and 42D are provided between the two plates a1 and a2 constituting each of the stationary partition plates 40A, 40B, 40C, and 40D so as to be vertically slidable with the movable valving element 26.

Thus, the feature of the sixth embodiment consists in that it has the valve-integrated partition plates 42A, 42B, 42C, and 42D integrally formed with the movable valving element 26, corresponding to the four stationary partition plates 40A, 40B, 40C, and 40D; and the arrangement in which the stationary partition plates 40A, 40B, 40C, and 40D, and the valve-integrated partition plates 42A, 42B, 42C, and 42D are mounted so as to be overlapping with one another, respectively. This restrains a communication among the introducing passages 14A, 14B, 14C, and 14D not only at the time of EGR valve closing, but also at the time of valve opening, and can cut off an inflow of intake air from another introducing passages to enable efficient taking in of air.

Alternatively, even if taking the arrangement not constituted by the two opposed stationary partition plates a1, a2, in other words, the arrangement constituted by single mutually overlapping stationary partition plate and the valve-integrated partition plate, a similar effect will be obtained basically. Notwithstanding, it may expect to improve a sealing effect in case of taking the arrangement constituted by two opposed stationary partition panels a1, a2.

SEVENTH EMBODIMENT

Figure 12:
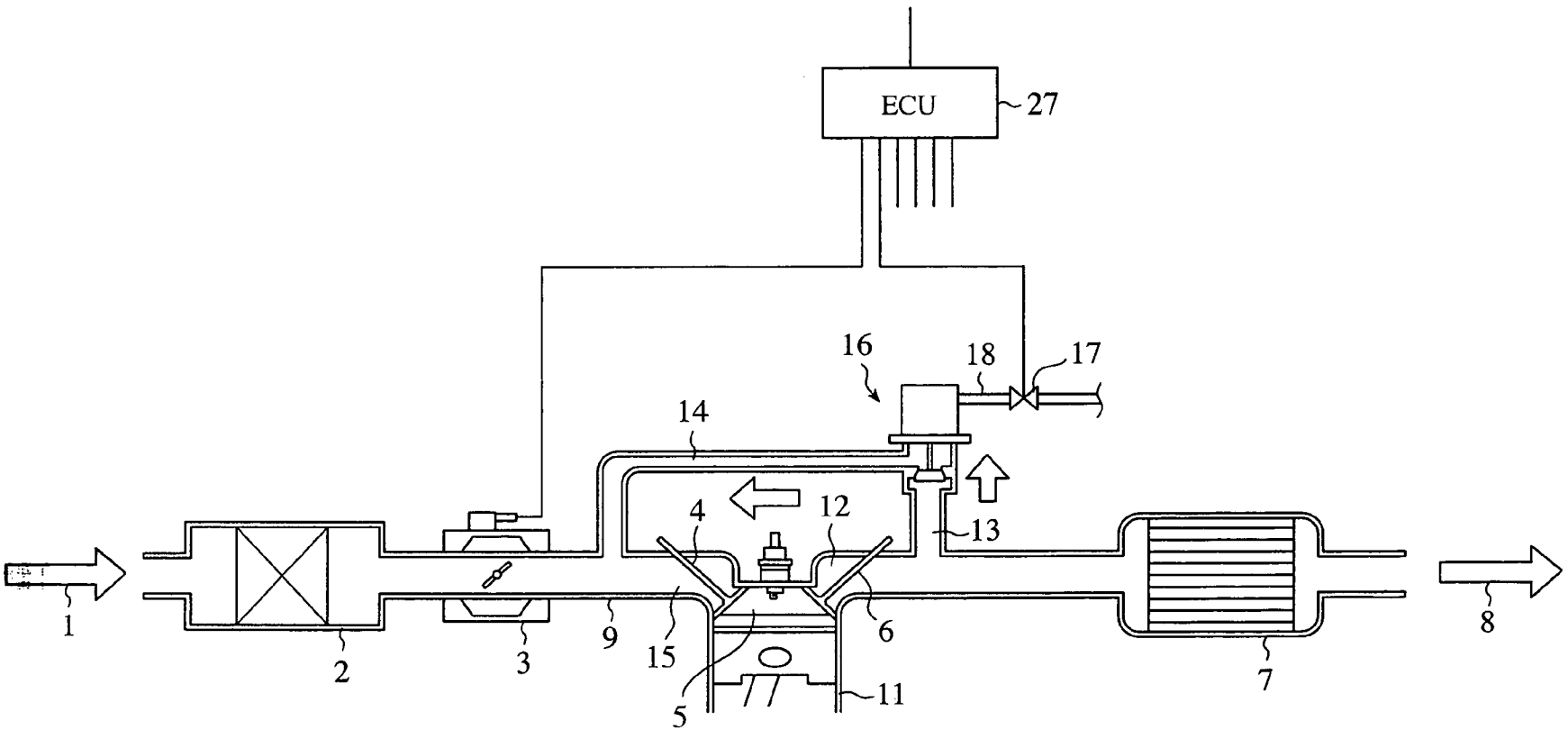
FIG. 12 is a view explaining an outline of the exhaust-gas recirculation system.

The seventh embodiment is different from those described hereinabove in an arrangement in which an EGR valve 16 has its inlet at the lower portion thereof and its outlet at the upper portion thereof as shown in FIG. 12. The other arrangements thereof are the same as those already described with reference to FIG. 1. Hereupon, an arrangement may be taken in which a motor is driven to move the valving element against repulsion of the spring for opening and closing the valve in place of applying negative pressure on the valve by using the tube 18. In this case, an ECU 19 outputs an on-off instruction controlling the valve to drive the motor.

Figure 13:
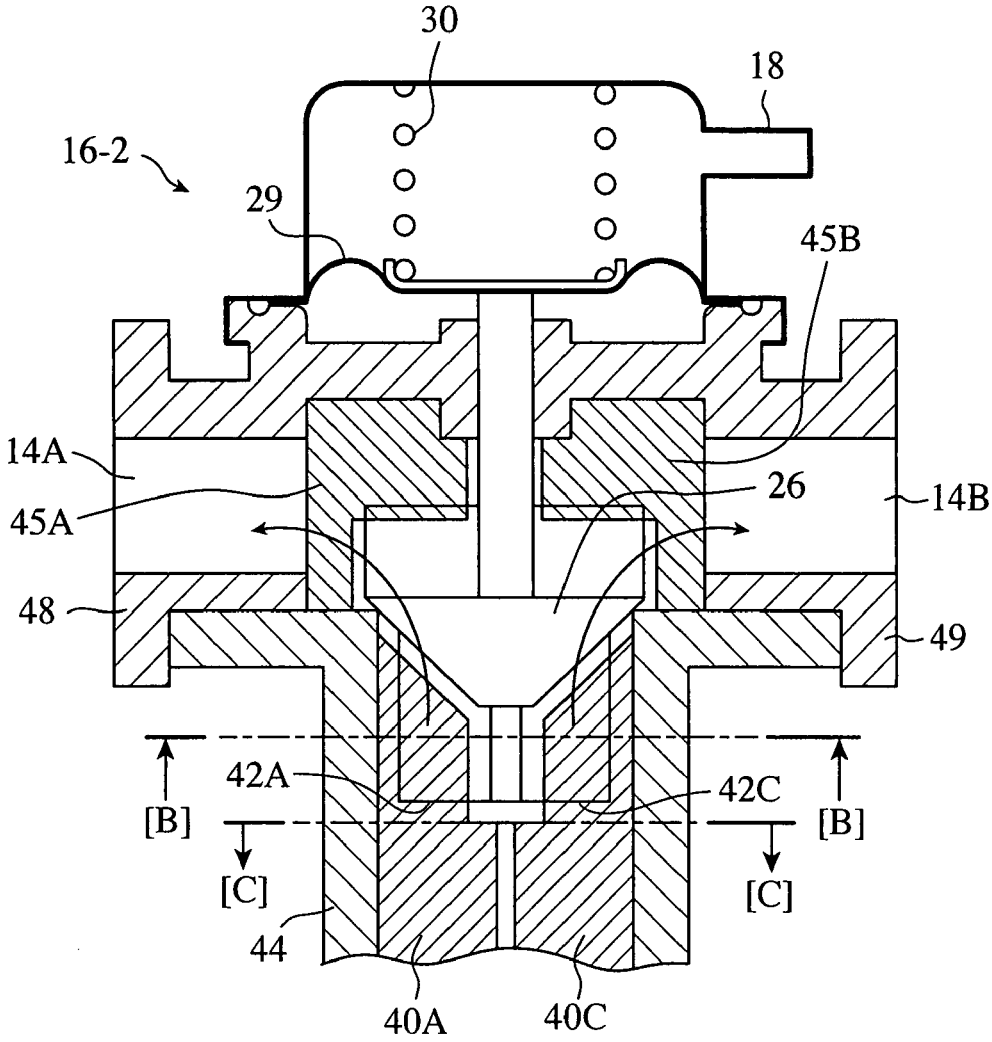
FIG. 13 is a sectional view of the EGR valve.
Figure 14:
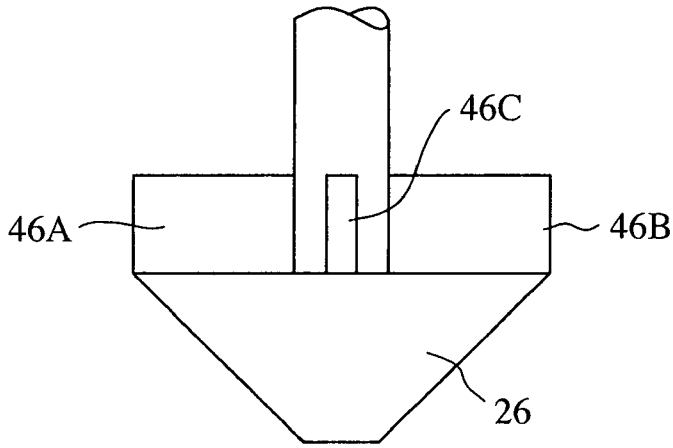
FIG. 14 is a front view of the movable valving element in FIG. 13.

The seventh embodiment will be described with reference to FIG. 13 and FIG. 14. Referring to FIG. 13, the EGR valve 16-2 has its inlet at the lower portion thereof and its outlet at the upper portion thereof. On the inlet side of the lower portion, the interior of the barrel 44 is partitioned into parts correspondingly to the number of the exhaust ports of the internal combustion engine, and is admitted to the takeoff passage 13 (see FIG. 12).

The takeoff-passage stationary-partition plates that are partition members and the takeoff-side valve-integrated partition plates, which are provided integrally with the movable valving element of the valve, correspondingly to the takeoff-passage stationary partition plates, correspond to the stationary partition plates 40A, 40B, 40C, and 40D, and the valve-integrated partition plates 42A, 42B, 42C, and 42D, respectively, shown in FIG. 8 in the sixth embodiment, and their arrangements are quite the same to the details. Therefore, the sections shown in FIG. 13, corresponding to those shown in FIG. 8, are designated by the same reference numerals enclosed in brackets [ ], and explanations thereof are omitted for brevity's sake.

In addition, assume that the section taken along the line [B]-[B] shown in FIG. 13 presents the same sectional form as that shown in FIG. 9, and the section taken along the line [C]-[C] section shown in FIG. 13 presents the same sectional form as that shown in FIG. 11. In the seventh embodiment, the takeoff-passage stationary-partition plates [40A], [40B], [40C], and [40D], and the takeoff-side valve-integrated partition plates [42A], [42B], [42C], and [42D] are disposed in an overlapping manner, respectively.

Further, referring to FIG. 12, even on the outlet side of the upper portion thereof are provided four introducing passages 14A, 14B (in rightward and leftward directions) and introducing passages 14C, 14D (in the direction piercing through the space, but an illustration thereof is omitted for simplification), in four directions, i.e., in rightward and leftward directions, and forward and backward directions piercing through space, and these introducing passages 14A, 14B, 14C, and 14D are provided with stationary partition plates 45A, 45B (in rightward and leftward directions) and stationary partition plates 45C, 45D (in the direction piercing through space, but an illustration thereof is omitted for simplification), which constitute the branching section, by securing the stationary partition plates to barrels 48, 49 each forming an introduction flow path. Further, as also shown in FIG. 13, these stationary partition plates 45A, 45B are disposed directly opposed to the movable valving element 26, and the movable valving element 26 is provided with the valve-integrated partition plates 46A, 46B (in rightward and leftward directions) and the valve-integrated partition plates 46C, 46D (in the direction piercing through the space) partially overlapped on the above stationary partition plates 45A, 45B.

These upper partition plates and lower partition plates are disposed at four circumferentially equally divided positions such that a phase within the barrel is not shifted, and thereby, as shown in FIG. 12, the takeoff passage 13 and the introducing passage 14 amount to an independent state among the cylinders. This further reduces an interference of an intake and also retrains a communication between the EGR passages even in the arrangement in which an inlet is situated at the lower portion and an outlet at the upper portion thereof.

EIGHT EMBODIMENT

Figure 15:
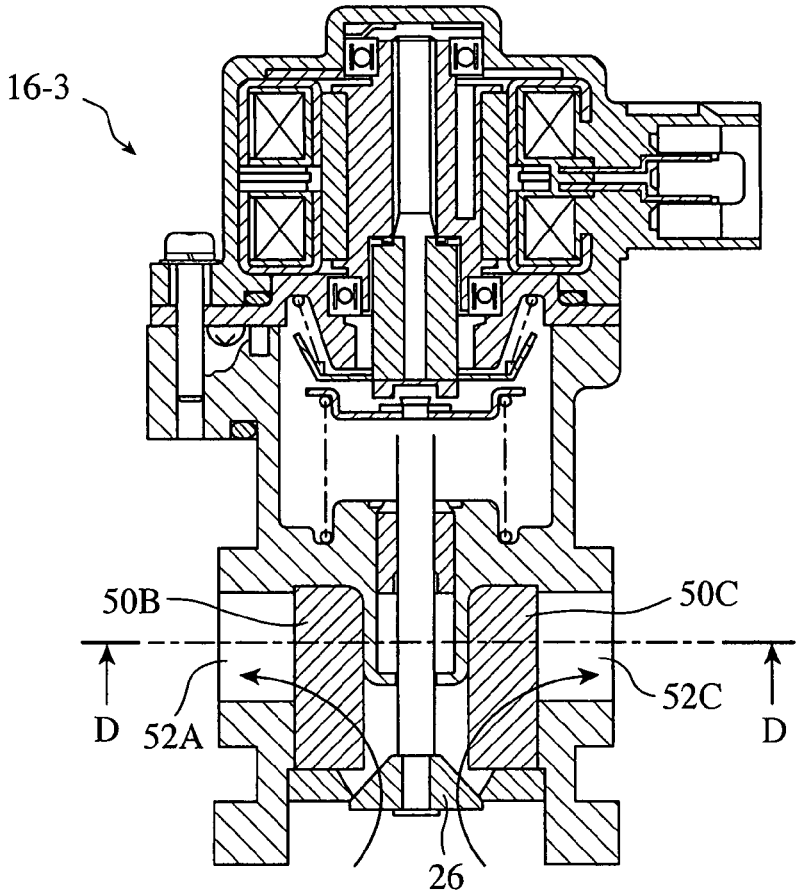
FIG. 15 is a sectional view of the EGR valve.

The eighth embodiment will be described with reference to FIG. 15 and FIG. 16. As is given a rough sketch at the beginning of the seventh embodiment, the EGR valve 16-3 of the eight embodiment is a type of opening and closing the valve by moving the movable valving element 26 against repulsion of the spring by motor driving, where the inlet of the EGR valve 16-3 is located at the lower portion thereof, and the outlet thereof is located at the upper portion thereof. The inlet of the lower portion thereof communicates with the takeoff passage 13 shown in FIG. 12. In the meantime, the outlet of the upper portion thereof is branched into all directions by the branching section consisting of in-valve partition plates 50A, 50B, 50C, and 50D provided at 90 degree intervals in all directions within the EGR valve 16-3.

Figure 16:
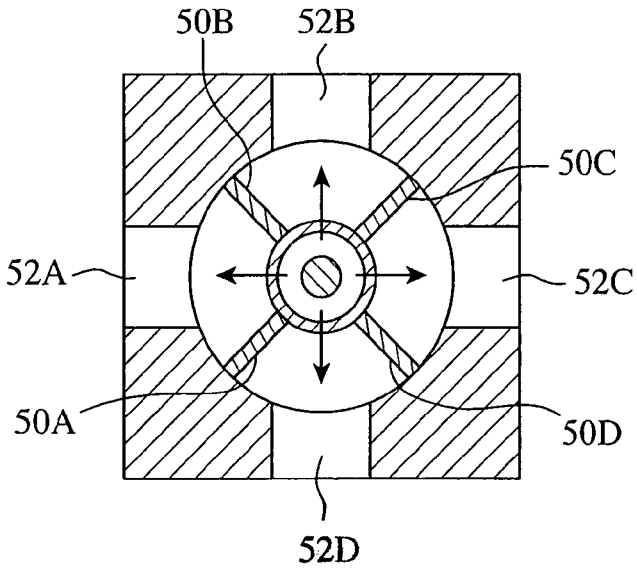
FIG. 16 is a sectional view of the EGR valve taken along line D-D in FIG. 15.

As shown in FIG. 16, four areas, which are partitioned so as to be branched by these in-valve partition plate 50A, 50B, 50C, and 50D, communicate with four introducing passages 52A, 52B, 52C, and 52D, leading to the intake ports 15A, 15B, 15 C, and 15D of four cylinders, respectively. The in-valve partition plates 50A, 50B, 50C, and 50D are directly opposed to the movable valving element 26, and are disposed in close vicinity to the element as shown in FIG. 16. For this reason, at the time of valve closing, each of the introducing passages 52A, 52B, 52C, and 52D is restrained from communicating with another introducing passages, preventing loss of the intake efficiency.

NINTH EMBODIMENT

Figure 17:
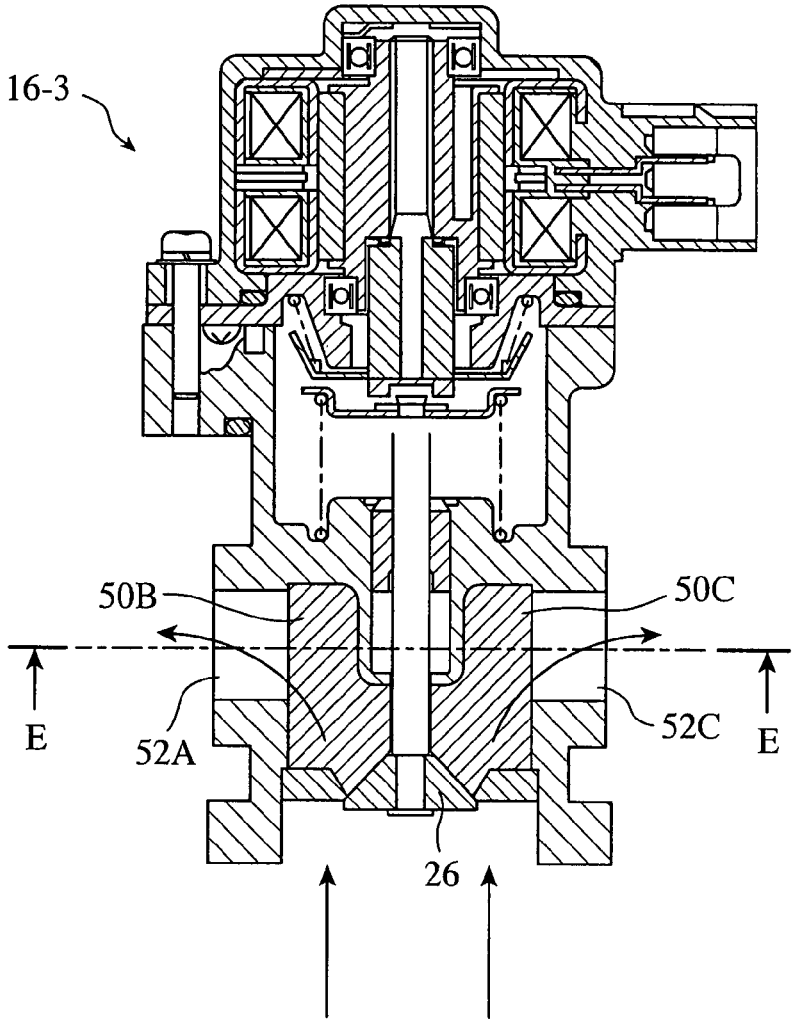
FIG. 17 is a sectional view of the EGR valve.
Figure 18:
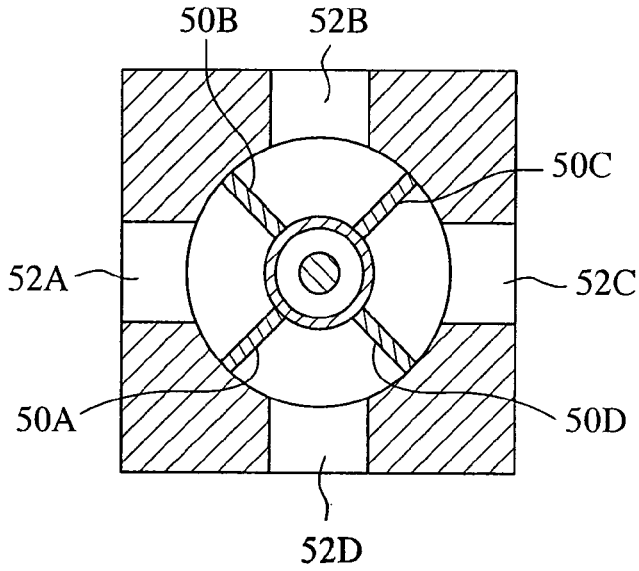
FIG. 18 is a sectional view of the EGR valve taken along line E-E in FIG. 17.

The ninth embodiment will be described with reference to FIG. 17 and FIG. 18. The ninth embodiment is a modification of the eight embodiment described above. Therefore, the same sections are designated by the same reference numerals, and explanations thereof are omitted for brevity's sake. In the ninth embodiment, the lower end of the in-valve partition plates 50A, 50B, 50C, and 50D are mounted so as to be contacted with the conical sloped portion of the movable valving element 26 at a valve-closed position. This leaves no clearance between the partition plates and the valve, and thereby, at the time of valve closing, each of the introducing passages 52A, 52B, 52C, and 52D is restrained from communicating with another introducing passages, thus further preventing loss of the intake efficiency.

TENTH EMBODIMENT

Figure 19:
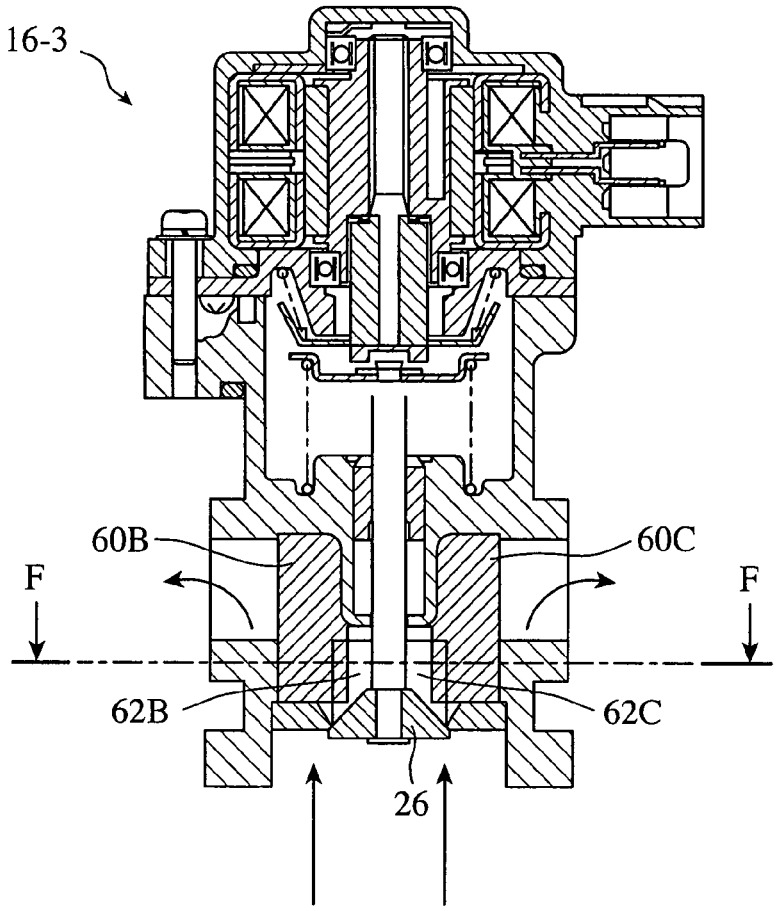
FIG. 19 is a sectional view of the EGR valve.

The tenth embodiment will be described with reference to FIG. 19 and FIG. 20. The tenth embodiment is a modification of the eight and ninth embodiments described above. The inlet of the EGR valve 16-3 is situated at the lower portion of the valve, and the outlet thereof at the upper portion of the valve. The inlet of the lower portion communicates with the takeoff passage 13 shown in FIG. 12. In the meantime, the outlet of the upper portion is branched into all directions by the branching section consisting of the in-valve partition plates 60A, 60B, 60C, and 60D, each composed of a pair of two opposed plates c, d, provided at 90 degree intervals in all directions within the EGR valve 16-3.

Figure 20:
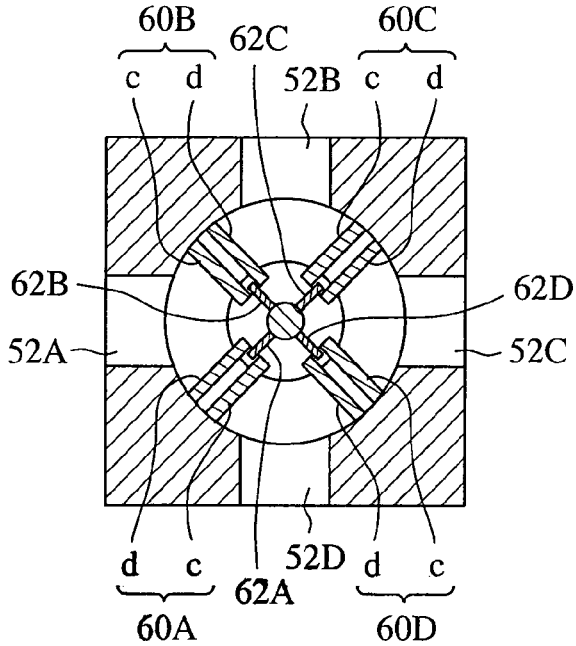
FIG. 20 is a sectional view of the EGR valve taken along line F-F in FIG. 19.

As shown in FIG. 20, four areas, which are partitioned so as to be branched by these in-valve partition plates 60A, 60B, 60C, and 60D, communicate with four introducing passages 52A, 52B, 52C, and 52D, leading to the intake ports 15A, 15B, 15 C, and 15D of four cylinders, respectively. The in-valve partition plates 60A, 60B, 60C, and 60D are directly opposed to the movable valving element 26, and are disposed in close vicinity to the element as shown in FIG. 20.

Meanwhile, to the conical portion of the movable valving element 26 is secured in all directions valve-integrated partition plates 62A, 62B, 62C, and 62D, integrally with the element according to the embodiment shown in FIG. 10, and the valve-integrated partition plates are disposed in a partially overlapping manner to the in-valve partition plates 60A, 60B, 60C, and 60D, respectively. More particularly, the valve-integrated partition plates are slidably located between its opposed plate c and plate d. In the tenth embodiment, even when the movable valving element 26 moved to open and close the valve, it is ensured that overlapping of the valve-integrated partition plates with the in-valve partition plates 60A, 60B, and 60C and 60D, respectively, is maintained within the range of the movement. Thereby, a communication between the EGR passages is restrained not only at the time of valve opening, but also at the time of valve closing.

ELEVENTH EMBODIMENT

The eleventh embodiment will be described with reference to FIG. 12, and FIGS. 21-23. The exhaust-gas recirculation system shown in FIG. 12 includes the takeoff passage 13 of exhaust gas communicating with the exhaust port 12 of the internal combustion engine; the introducing passage 14 of exhaust gas communicating with the intake port 15 of the engine; the EGR valve 16 provided between these takeoff passage 13 and introducing passage 14; and the control means (ECU 27) for controlling an opening and closing operation of the valve. The introducing passage 14 is branched, on the outlet side, correspondingly to the number of the exhaust port of the internal combustion engine, in the eleventh embodiment, into four parts.

Figure 21:
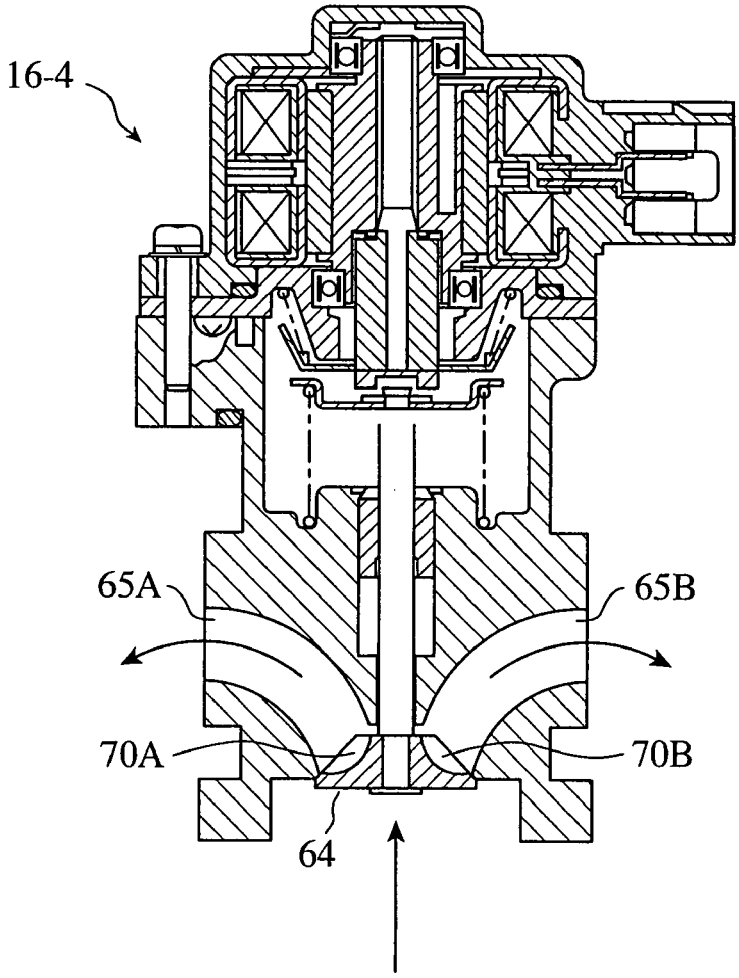
FIG. 21 is a sectional view of the EGR valve.
Figure 22:
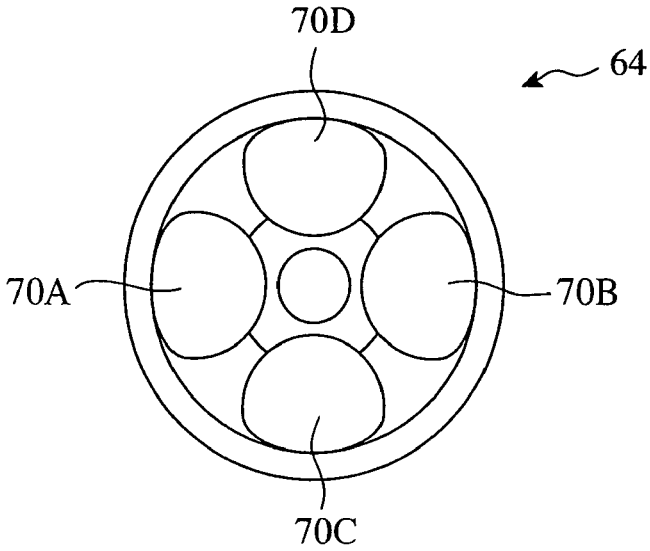
FIG. 22 is a plan view of the movable valving element thereof.
Figure 23:
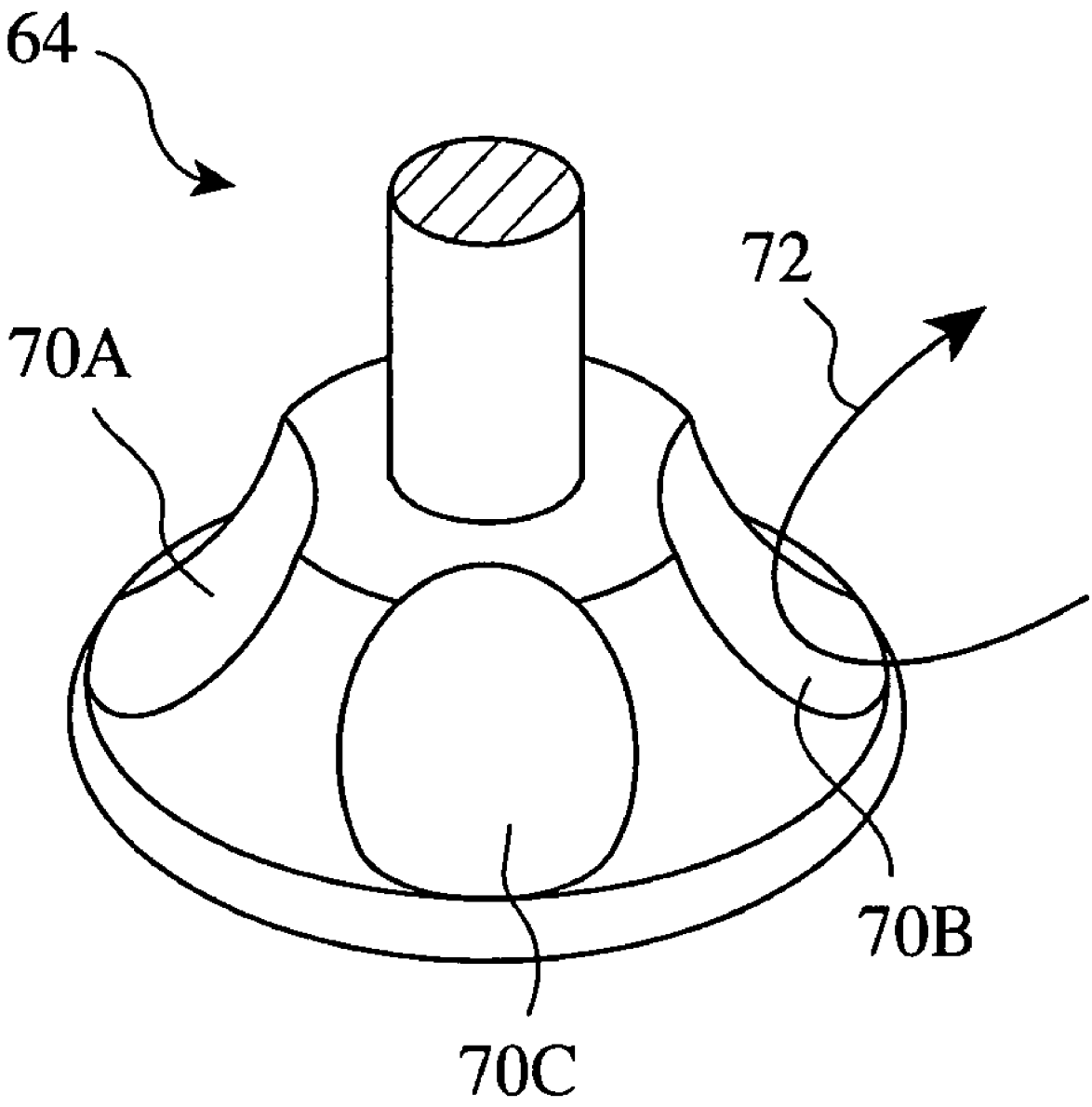
FIG. 23 is an oblique view of the movable valving element thereof.

Referring to FIGS. 21-23 showing a specific example of the EGR valve 16, intake ports 65A-65D (only the right and left intake ports 65A, 65B are shown in FIG. 21 for indication of cross section) are opposingly opened to the conical face of the movable valving element 64, and communicate at this portion with one another. In the eleventh embodiment, concaves 70A, 70B, 70C, and 70D each forming part of the passage of gas from the exhaust port 12 of each of the cylinders are formed at an opposing portion, which is positioned at the conical sloped portion of the movable valving element 64.

Each of these concavities 70A, 70B, 70C, and 70D is formed of a concavely curved surface having a round outline, and exhaust gas flowed thereinto from the lower portion thereof at the time of valve opening, is led to the intake port 15 shown in FIG. 12 through the intake ports 65A-65D. The exhaust gas flows with low resistance along the concave 70B formed of the surface along which the gas can easily flow, at the time of valve opening, as shown by arrow 72 in FIG. 23. This prevents the flow rate of the gas from being dropped due to an increase of ventilation resistance caused by the branching section or the addition of the partition plates, which secures the demanded flow rate without enlarging the exhaust gas passage.

INDUSTRIAL APPLICABILITY

As described above, the exhaust-gas recirculation system according to the present invention is suitable for solving the aggravation of the air-gas efficiency by communicating the introducing passages of exhaust gas with a plurality of intake ports of the internal combustion engine to approach as near as possible the state in which each of the introducing passages is isolated from the other introducing passages.

The invention claimed is:

1. An exhaust-gas recirculation system comprising:

a takeoff passage of exhaust gas communicating with an exhaust port of an internal combustion engine;

an introducing passage of exhaust gas communicating with an intake port of the engine;

a valve provided between the takeoff passage and the introducing passage, the valve opening and closing by contacting a movable valving element with a valve seat and separating it therefrom; and a control means for controlling an opening and closing operation of the valve, wherein the introducing passage is branched on an outlet side of the valve into parts, correspondingly to the number of the intake port of the internal combustion engine, wherein a branching section is located at a position directly opposed to the movable valving element of the valve, and wherein the branching section is constituted by in-valve partition plates provided within an opening and closing valve and a plurality of areas partitioned by the in-valve partition plates are opposed to the respective introducing passages of the internal combustion engine.

2. The exhaust-gas recirculation system according to claim 1, comprising valve-integrated partition plates provided correspondingly to the stationary partition plates and formed integrally with the movable valving element of the valve, wherein each of the stationary partition plates and the valve-integrated partition plates are disposed in an overlapping manner with each other.

3. The exhaust-gas recirculation system according to claim 2, comprising takeoff-passage stationary-partition plates, which partition, on the inlet side of the valve, the takeoff passage into parts correspondingly to the number of the exhaust port of the internal combustion engine; and takeoff-side valve-integrated partition plates provided integrally with the movable valving element of the valve, wherein these takeoff-passage stationary-partition plates and takeoff-side valve-integrated partition plates are disposed in an overlapping manner with each other.

4. The exhaust-gas recirculation system according to claim 1, wherein the end of the in-valve partition plates are disposed so as to be contacted with the valve at a valve closing position thereof.

5. The exhaust-gas recirculation system according to claim 1, comprising the valve-integrated partition plates provided integrally with the movable valving element of the valve, wherein the in-valve partition plates and these valve-integrated partition plates are disposed in an overlapping manner with each other.

6. An exhaust-gas recirculation system comprising:

a takeoff passage of exhaust gas communicating with an exhaust port of an internal combustion engine;

an introducing-passage of exhaust gas communicating with an intake port of the internal combustion engine;

a valve provided between the takeoff passage and the introducing passage, the valve opening and closing by contacting a movable valving element with a valve seat and separating it therefrom; and a control means for controlling an opening and closing operation of the valve, wherein the introducing passage is branched, on an outlet side of an opening and closing valve, into parts, correspondingly to the number of the exhaust port of the internal combustion engine, wherein a concave forming part of the passage of gas from the exhaust port thereof is formed on an opposing portion of the movable valving element of the valve, which is opposed to the intake port thereof.

* * * * *